US005373155A

United States Patent [19]

Chen

[11] Patent Number: 5,373,155

[45] Date of Patent: Dec. 13, 1994

[54] ENGAGEMENT OF FOCUSING LENSES WITH PLASTIC SHELLS FOR ENCLOSING INFRARED LIGHT DETECTORS

[76] Inventor: Kent Chen, 5th Fl., No. 16, Lane 130, Min Chuan Rd., Hsin Tien City, Taipei Hsien, Taiwan, Prov. of China

[21] Appl. No.: 139,164

[22] Filed: Oct. 21, 1993

[51] Int. Cl.[5] ..... H01J 5/02

[52] U.S. Cl. ..... 250/239; 250/216; 250/338.1

[58] Field of Search ..... 250/239, 216, 338.1, 250/341, 347

[56] References Cited

U.S. PATENT DOCUMENTS 5,173,810 12/1992 Yamakawa ..... 250/216

5,227,632 7/1993 Armstrong et al. ..... 250/216

*Primary Examiner*—David C. Nelms

*Assistant Examiner*—Que T. Le

*Attorney, Agent, or Firm*—Leydig, Voit & Mayer

[57] ABSTRACT

A shell for containing infrared light detector. The shell has a focusing lens with a periphery through which a number of holes are formed and a panel molded from molten plastic. When the panel is being molded, the molten plastic flows through the holes so that the portion of the plastic functions as a number of latches inserted through the holes.

1 Claim, 2 Drawing Sheets

ENGAGEMENT OF FOCUSING LENSES WITH PLASTIC SHELLS FOR ENCLOSING INFRARED LIGHT DETECTORS

BACKGROUND OF INVENTION

1. Field of Invention

The present invention relates to engagement of focusing lenses with plastic shells for enclosing infrared light detectors.

2. Related Prior Art

Various automatic control apparatuses have been used in order to help people perform various tasks. Automatic control apparatuses often employ detectors which are able to detect infrared light emitted from objects within certain distances therefrom. As such detectors are often installed outdoors, they are exposed to the weather, therefore, they must be enclosed in shells for protection of their electric parts. Concave lenses are mounted in openings formed in the shells so that infrared light is allowed to penetrate the focusing lenses in order to reach the detectors.

In a first type of conventional detector, a rectangular opening is formed in a shell so as to form a lower horizontal rim, an upper horizontal rim and two vertical rims. A slot is formed in the lower horizontal rim of the shell. Accordingly, a focusing lens has a lower horizontal rim, an upper horizontal rim and two vertical rims. The lower horizontal rim of the focusing lens is received in the slot formed in the lower horizontal rim of the shell. The upper horizontal rim of the focusing lens is disposed against the upper horizontal rim of the shell. Glue is provided in the slot and between the upper horizontal rim of the focusing lens and the upper horizontal rim of the shell. Thus, the focusing lens is mounted on the shell. In accordance with a second type of prior art, the focusing lens is only glued on the shell. In the above-mentioned types of prior art, the engagement of the focusing lenses with the shells is not sufficiently firm as the focusing lenses are basically glued on the shells. If a gap occurs between a focusing lens and a shell, electric parts received in the shell will be exposed to the weather. Therefore, present invention is intended to solve the problem.

SUMMARY OF INVENTION

It is the primary object of the present invention to provide engagement of a focusing lens with a shell for enclosing electric parts. The shell has a focusing lens with a periphery through which a number of holes are formed and a panel molded from molten plastic. When the panel being molded, the molten plastic flows through the holes so that the portion of the plastic functions as a number of latches inserted through the holes.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
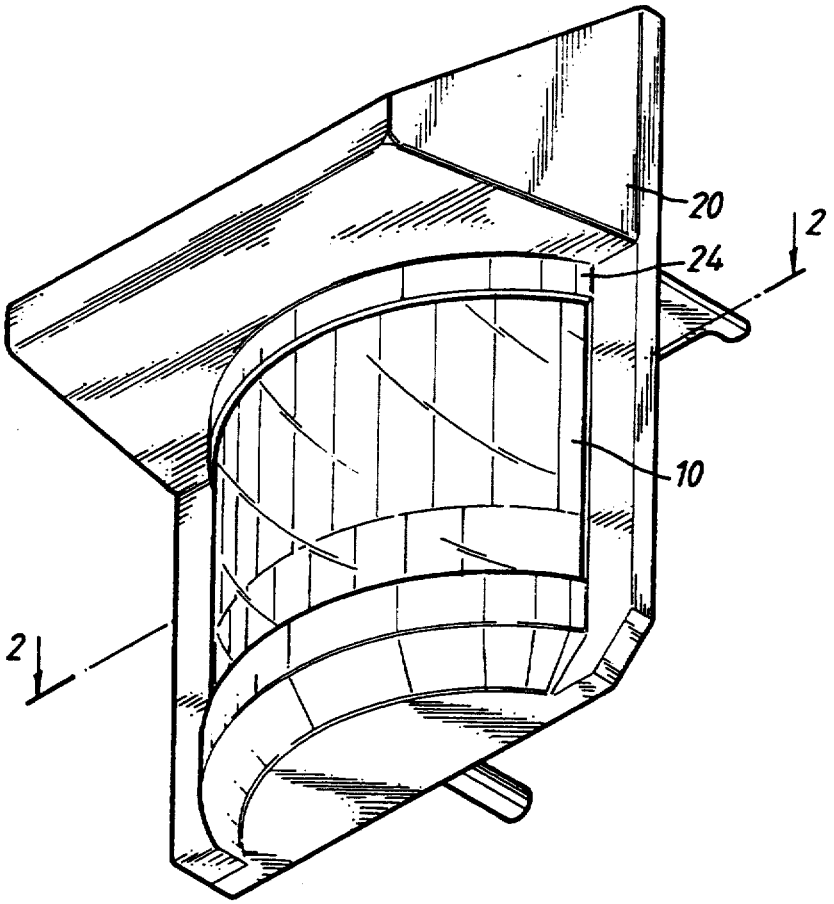
FIG. 1 is a perspective view of a focusing lens mounted on a plastic shell in accordance with the preferred embodiment of the present invention.

Referring to FIG. 1 of the drawings, a focusing lens 10 is mounted on a front panel 20 of a plastic shell.

Figure 2:
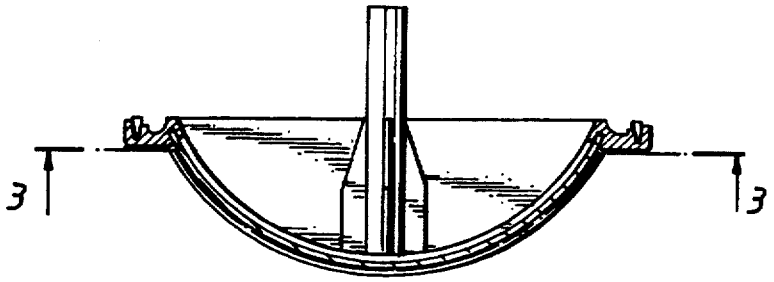
FIG. 2 is a cross-sectional view taken along a line 2—2 in FIG. 1.
Figure 3:
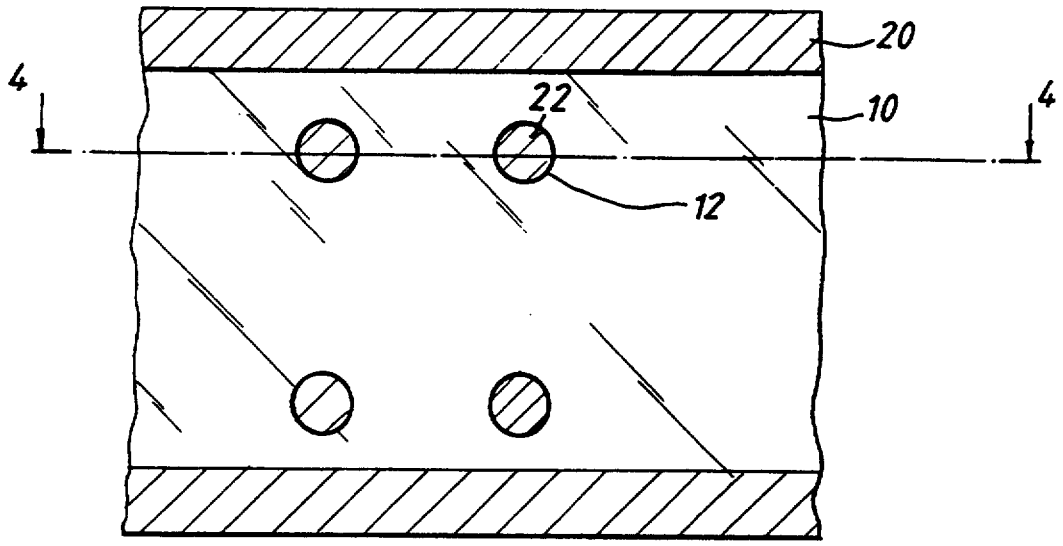
FIG. 3 is a cross-sectional view taken along a line 3—3 in FIG. 2.

The focusing lens 10 is a rectangular strip molded from high density polyethylene (HDPE) with a heat distortion temperature (HDT) of 61° C. The focusing lens 10 is curved as an arc when mounted on the front panel 20 (see FIG. 2 of the drawings). The focusing lens 10 is substantially identical to any conventional focusing lens except for a series of holes formed through an upper rim thereof and another series of holes formed through a lower rim thereof (see FIG. 3 of the drawings).

Figure 4:
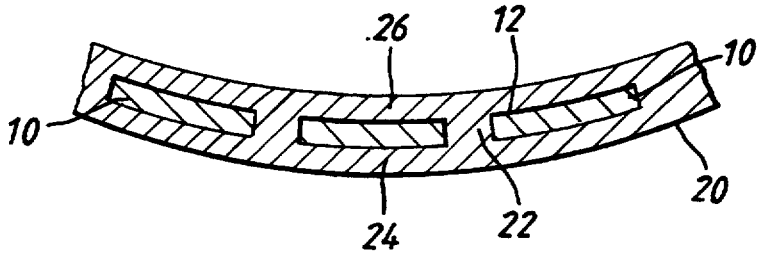
FIG. 4 is a cross-sectional view taken along a line 4—4 in FIG. 3.

The focusing lens 10 is disposed in a mold (not shown) for the panel 20. Molten modified Poly Phenylene Oxide (PPO NORTL) with a HDT of 100° C. is induced in the mold so that the molten modified NORTL flows through the holes 12. As 23 the molten modified NORTL hardens, there forms the panel 20 with two upper slender limits 24 and 26 (see FIG. 4 of the drawings) between which the upper rim of the focusing lens 10 is disposed and two lower slender limits between which the lower rim of the focusing lens 10 is disposed. The portion of NORTL disposed in the holes 12 functions as a number of latches 22 (see FIGS. 3 and 4) inserted through the holes 12 so that the focusing lens 10 is restrained on the panel 20.

The temperature of the focusing lens 10 at this point is lower than its HDT, i.e., 61° C. The temperature of the molten modified NORTL exceeds 100° C. That is, heat is transferred from the molten modified NORTL to the focusing lens 10 when the molten NORTL is induced in the mold. There is a risk that the focusing lens 10 might be distorted if its temperature reaches 61° C. Therefore, it is necessary for more cooling to be directed at the portion of the mold adjacent to the focusing lens 10.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. The shell for containing infrared light detector, said shell comprising:

a focusing lens comprising a periphery through which a number of holes are formed; and a panel molded from molten plastic, when panel is being molded, the molten plastic flowing through the holes so that the portion of the plastic functions as a number of latches inserted through the holes.

* * * * *